United States Patent [19]

Mileti

[11] Patent Number: 4,878,636

[45] Date of Patent: Nov. 7, 1989

[54] KITE BRIDLE AND LINK SYSTEM AND METHOD FOR MAKING SAME

[76] Inventor: Robert J. Mileti, 21 Taylor St., Torrington, Conn. 06790

[21] Appl. No.: 308,741

[22] Filed: Feb. 9, 1989

[51] Int. Cl.[4] ..... B64C 31/06

[52] U.S. Cl. ..... 244/155 A

[58] Field of Search ..... 244/153 R, 154, 155 R, 244/155 A

[56] References Cited

U.S. PATENT DOCUMENTS

| | | | |
|---|---|---|---|
| 3,740,009 | 6/1973 | Curtis | 244/153 R |
| 4,076,189 | 2/1978 | Powell | 244/153 R |
| 4,081,158 | 3/1978 | Pearce | 244/153 R |
| 4,760,979 | 8/1988 | Mileti | 244/153 R |

FOREIGN PATENT DOCUMENTS

| | | | |
|---|---|---|---|
| 856083 | 11/1970 | Canada | 244/153 R |
| 1535535 | 12/1978 | United Kingdom | 244/153 R |

*Primary Examiner*—Galen L. Barefoot

*Attorney, Agent, or Firm*—St. Onge Steward Johnston & Reens

[57] ABSTRACT

A kite bridle is provided for attaching a flying line to a kite. The bridle may include a link, cut from between branches of the bridle, for attaching a second kite to the flying line. Both the bridle and the link may be formed from a sheet of polymeric material with a continuous cut according to an interlocking pattern.

12 Claims, 5 Drawing Sheets

KITE BRIDLE AND LINK SYSTEM AND METHOD FOR MAKING SAME

TECHNICAL FIELD

This invention relates generally to kites, and more specifically to bridles for attaching a flying line to a kite.

BACKGROUND OF INVENTION

Kite bridles are known in the art. Prior art bridles are often made from string, typically of a type similar to that used as a flying line for a kite. Kite bridles are frequently connected to a kite by small metal rings or the like tied to ends of the string. An additional ring may be used to attach the flying line to the kite bridle.

Prior art kite bridles are disadvantageous for several reasons. The string may stretch, distorting the proper angle of the kite into the oncoming breeze. Further, the string may absorb moisture making a kite more difficult to fly in gentle breezes. Similarly, the rings often used to connect the bridle to the kite may slip, distorting the paper of the kite into the oncoming breeze; and increase the weight of the kite, making it yet more difficult to fly in gentle breezes. Prior art bridles may also require the additional labor costs associated with assembly, in that each ring must be tied to the string. Finally, prior art bridles may be difficult for some unsophisticated users to assemble them to the kite.

SUMMARY OF THE INVENTION

This invention relates to a bridle for attaching a flying line to a kite. The bridle may also include a link for attaching a second kite to the flying line. Both the link and the bridle are made from relatively inexpensive polymeric material. The link may advantageously be cut from between branches of the bridle, to minimize both the amount of scrap material and the weight of the bridle, with a continuous cut according to an interlocking pattern. The interlocking pattern may be mapped out on a die with a continuous blade.

It is an object of this invention to provide a kite bridle and link formed from a sheet of material. It is a further object of this invention to provide a relatively inexpensive and sturdy bridle for attaching a flying line to a kite.

These and other objects of the invention will become more apparent from the following detailed description when considered in light of the accompanying drawings and appended claims.

DETAILED DESCRIPTION OF INVENTION

Figure 1:
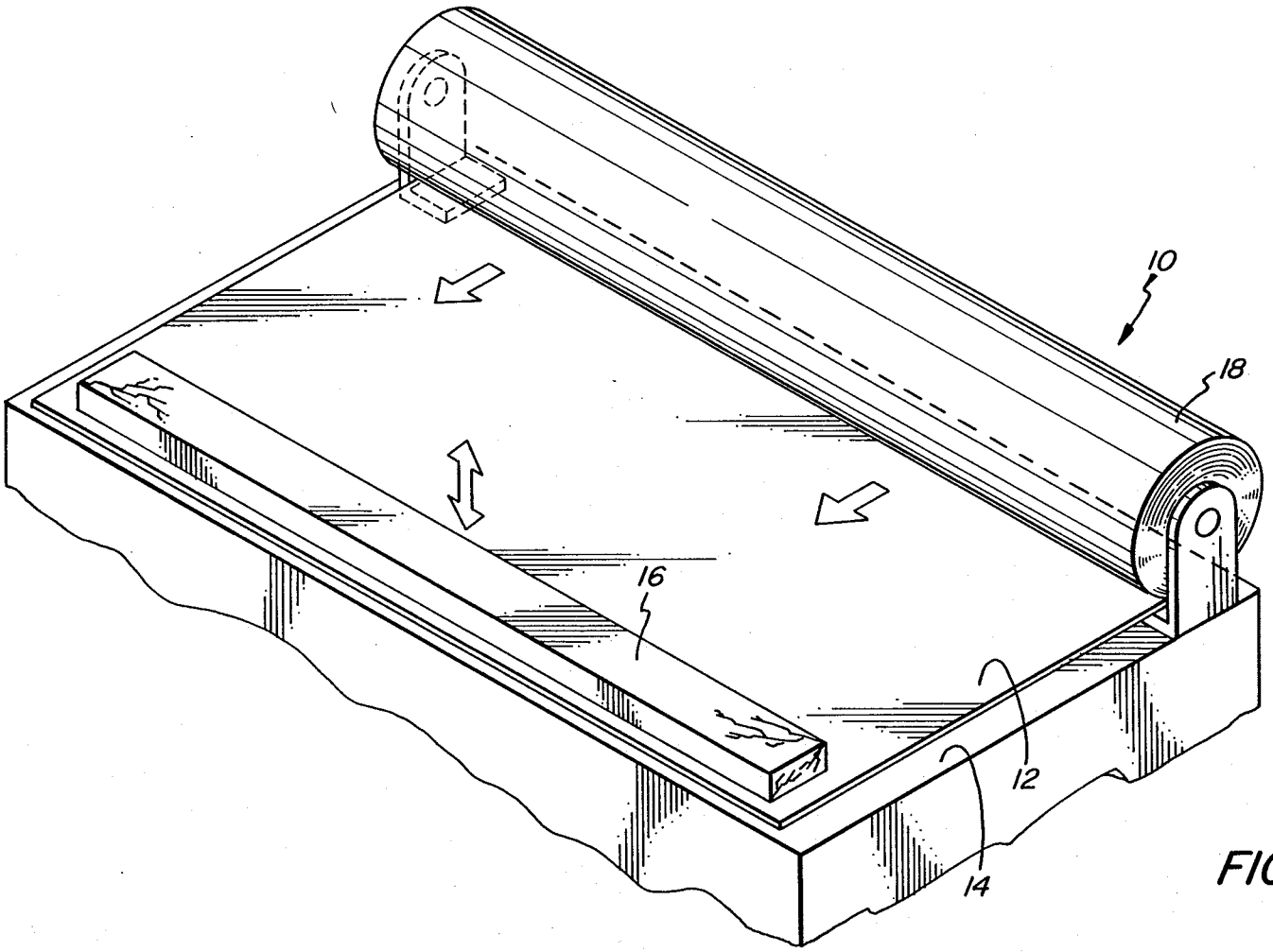
FIG. 1 schematically depicts, in a front perspective view, an apparatus for die cutting pieces from a sheet of material.

With reference to FIG. 1, an apparatus 10 is shown for die cutting pieces from a sheet 12 of polymeric material. Sheet 12 may preferably be provided as high density polyethylene, however other similar materials having relatively high flexibility and tensile strength such as polypropylene, nylon, thermoplastic, and the like may also be used. Sheet 12 is spread on a smooth, hard surface such as, for example, an anvil 14, and a die 16 is pressed into sheet 12 toward anvil 14 to cut pieces from sheet 12. Further, sheet 12 may conveniently be stored on a roll 18.

Figure 2:
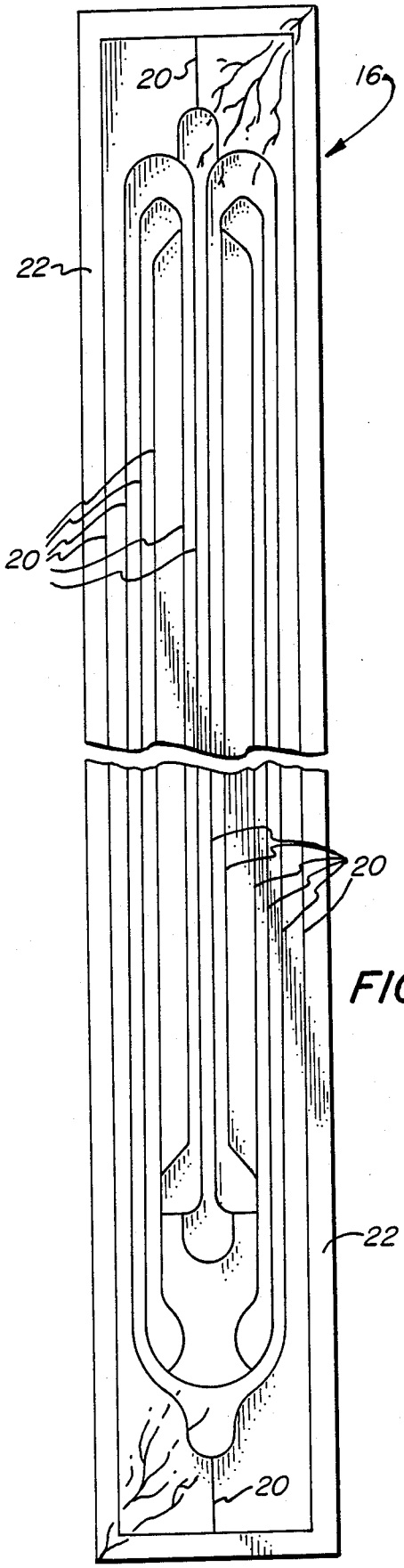
FIG. 2 is a bottom plan view of a die, depicting an interlocking pattern formed by the blade.
Figure 3:
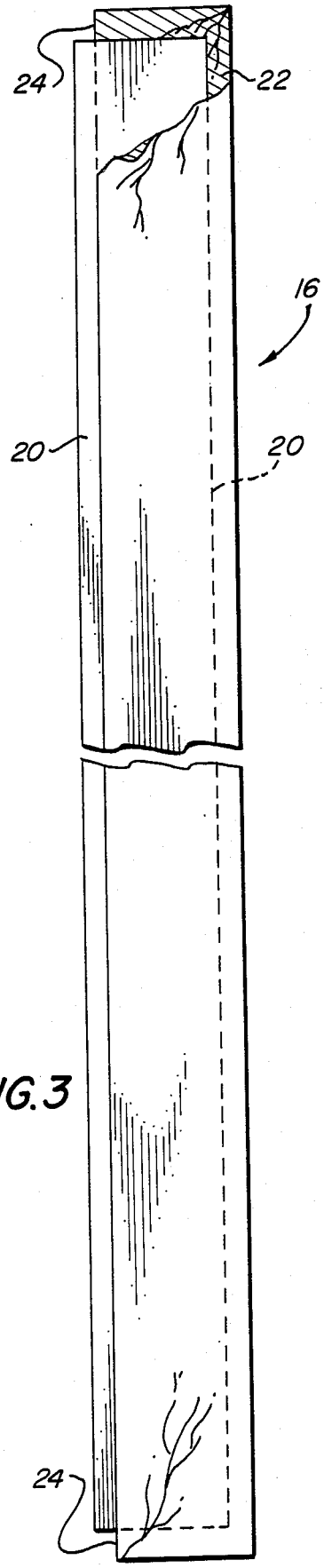
FIG. 3 is a partially cut-away side view of the die of FIG. 2 depicting how the blade is embedded therein.

Referring now to FIG. 2, a bottom plan view of die 16 shows a blade 20 mapped out on die 16 in an interlocking pattern. Referring now to FIG. 3, die 16 is preferably a block of wood 22 in which blade 20 is embedded. It should be understood that the die could be constructed in many different ways and could incorporate a blade in many different ways as well. Blade 20 extends from the bottom surface 24 of wood block 22 preferably just enough to cut through sheet 12, thereby preventing unnecessary wear to the blade.

Figure 4:
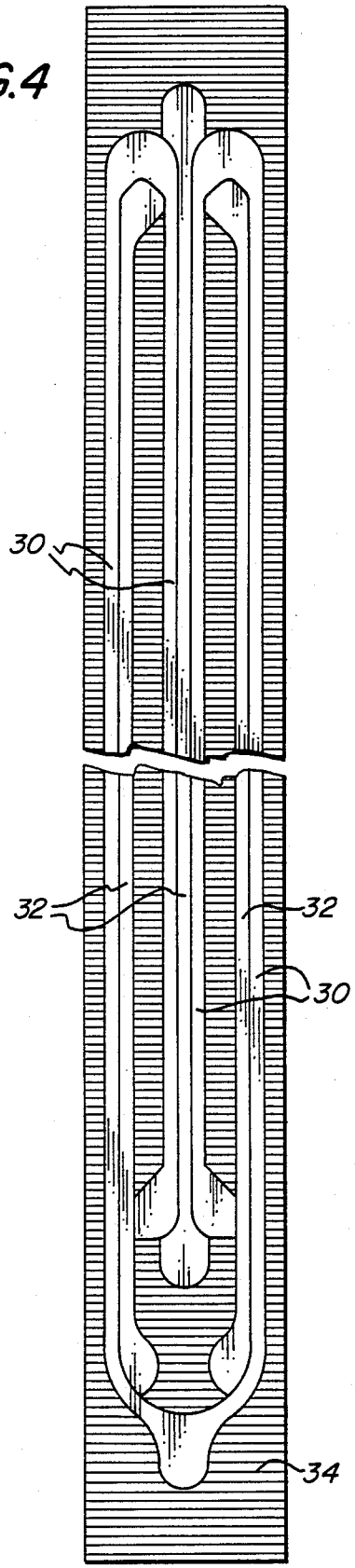
FIG. 4 is a top view of a strip cut from the sheet of material of FIG. 1 showing a bridle and link of this invention cut out thereon according to the interlocking pattern with he discarded portions shown shaded for clarity.

Referring now to FIG. 4, a kite bridle 30 and a kite link or extension 32 are shown cut, but not removed, from a strip 34 of material cut from sheet 12. The portions of the strip which are eventually removed and discarded are shown shaded for clarity. The shading helps highlight the interstitial fit of kite bridle 30 and kite link 32 shown on strip 34 in the interlocking pattern as cut by blade 20. Although a die is preferably used, any blade could follow the interlocking pattern and with a single continuous cut produce bridle 30 and link 32. Further, it should be understood that the bridle and link could be molded or otherwise formed. For example, a shortened version of the bridle and link may be cut from a thicker sheet of material which is then stretched to the desired length.

Figure 5:
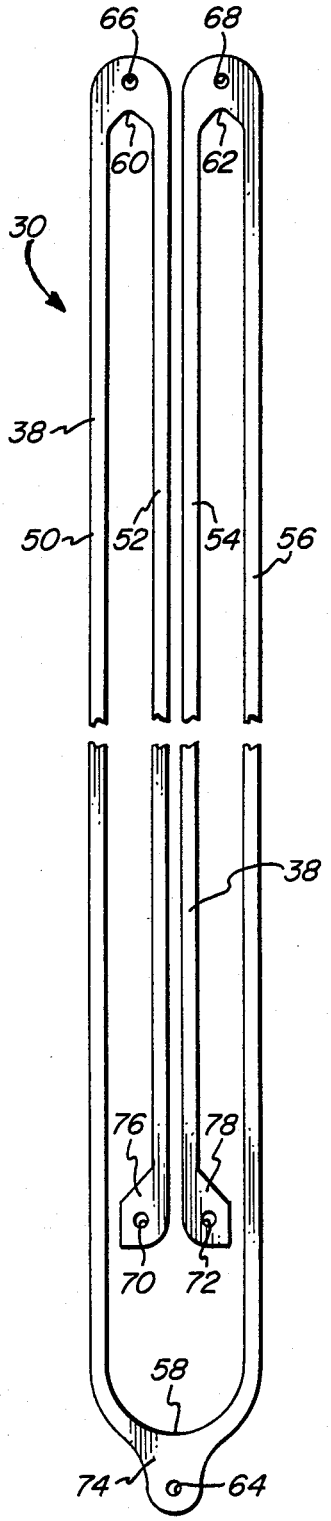
FIG. 5 is a top view of the bridle of FIG. 4 after being cut from the strip of FIG. 4.
Figure 6:
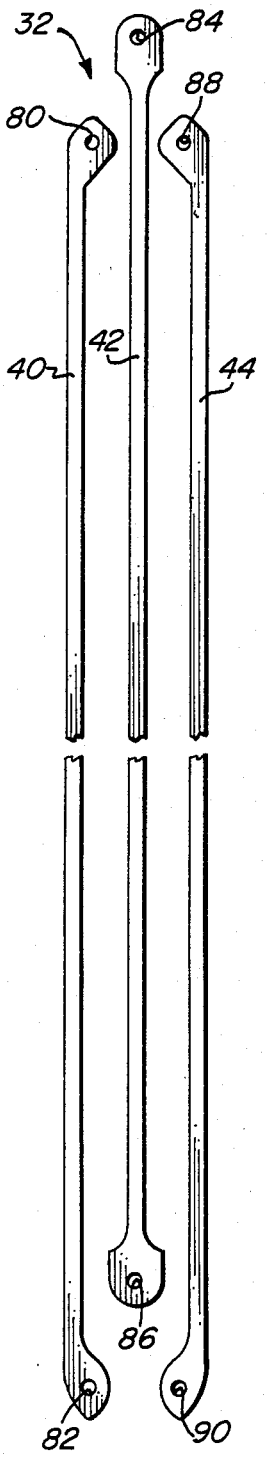
FIG. 6 is a top view of the link of FIG. 4 after being cut from the strip of FIG. 4.

Bridle 30 and link 32 comprise four individual pieces or lengths 38, 40, 42, and 44 of material as shown in FIGS. 5 and 6. Comparison of FIGS. 5 and 6 with FIG. 4 reveals that piece 38 is bridle 30, and pieces 40, 42, and 44 make up link 32.

FIG. 5 is a top view of bridle 30 after being separated from strip 34 as shown in FIG. 4. Bridle 30 has four branches 50, 52, 54, and 56, each being substantially parallel to the others. Branches 50 and 56 extend from a center joint 58 to respective flying live joints 60 and 62 of individual piece 38. Branches 52 and 54, then, extend from respective flying line joints 60 and 62 back toward center joint 58. Bridle 30 may alternatively be formed by folding piece 38 in half to form branches 50 and 56 and then further folding branches 50 and 56 each in half again to form branches 52 and 54. Branches 50 and 56 are longer than branches 52 and 54 by about 2½ inches in order to place the kite into the breeze at the optimum angle which will depend upon wind conditions.

Bridle 30 also has at least 5 holes: a center hole 64, two flying line holes 66 and 68, and two wing holes 70 and 72. Center hole 64 is located in a fin 74 which extends outwardly from center joint 58. The function of fin 74 is discussed below in conjunction with FIGS. 7 and 8. Flying line holes 66 and 68 are located in bridle 30 at flying line joints 60 and 62 and are used to attach a flying line to the bridle. Finally, wing holes 70 and 72 are located in ends 76 and 78 of length 38 from which bridle 30 is comprised. An array of holes are possible at each of these positions, and especially fin 74, in order to optimize the angle of the kite in accordance with the wind conditions.

FIG. 6 is a top view of link 32 after being separated from strip 34 as shown in FIG. 4. Pieces 40, 42, and 44 which form link 32 are equivalent in length for reasons discussed below with reference to FIG. 10. The pieces are preferably cut from between branches of the bridle in order to manufacture the bridle and link as economically as possible. Further, each of the pieces has holes in both ends: holes 80 and 82 in piece 40, holes 84 and 86 in piece 42, and holes 88 and 90 in piece 44. The holes enable interconnection of kites or kite sails so they may be flown with a single flying line. The length of branches 50 and 56 of bridle 30 and pieces 40, 42, and 44 of link 32 is preferably between about 30 inches and about 36 inches, but may be virtually any size necessary to mount to a selected kite. The width of the branches and the pieces is a function of the thickness of sheet 16 and its longitudinal strength. The branches and pieces must have a minimum tensile strength of twenty pounds per square inch in order to support the average kite. The thickness of the high density polyethylene preferably used is between about 0.030 inches and about 0.060 inches and the width of the branches and pieces is between about 0.150 inches and about 0.250 inches. Other combinations of thickness and width are possible and depend upon the strength of the particular material used.

Figure 7:
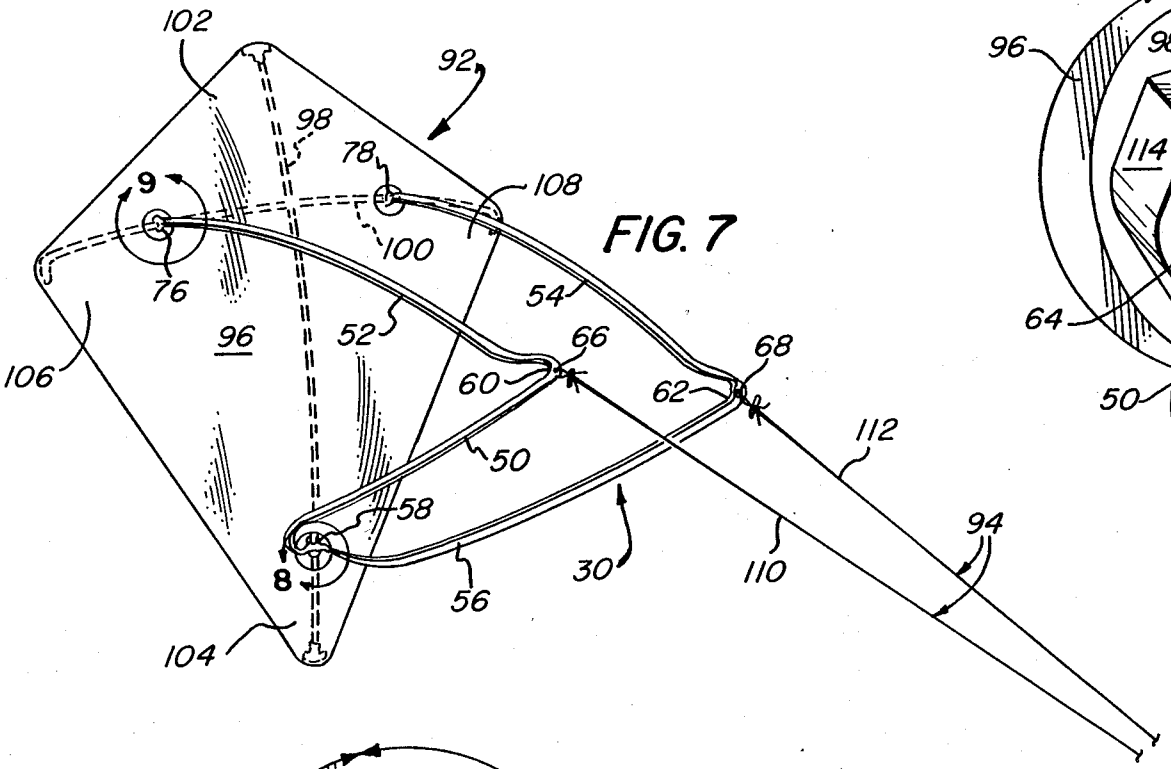
FIG. 7 is a perspective view of a kite with the bridle of FIG. 5 attached.

Referring now to FIG. 7, bridle 30 is shown in use, attached to both a kite 92 and a flying line 94. Kite 92 may, for example, include a sail 96, and two frame members 98 and 100. Frame member 98 extends from a nose portion 102 to a tail portion 104 of sail 96, and frame member 100 extends from a first or left wing portion 106 to a second or right wing portion 108 of sail 96.

For more skilled users, flying line 94 may advantageously comprise a left control line 110 and a right control line 112. Control lines 110 and 112 are secured to respective flying line holes 66 and 68 at joints 60 and 62. Bridle 30 is then attached to kite 92 at center joint 58 and at ends 76 and 78.

Figure 8:
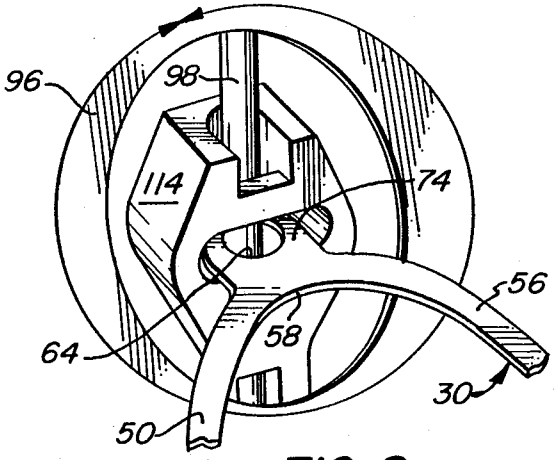
FIG. 8 is a partial enlargement of FIG. 7 depicting how the bridle of FIG. 5 may be attached at its center point to the kite.

FIG. 8 is a partial enlargement of FIG. 7 showing how center joint 58 of bridle 30 may be attached to kite 92. While center joint 58 of bridle 30 may be mounted in various ways to virtually any kite, bridle 30 is shown as preferably mounted to frame member 98 within a tail section 114 described in detail in U.S. Pat. No. 4,760,979. Frame member 98 fits through hole 64 in fin 74. Regardless of how bridle 30 is mounted, however, fin 74 functions to help prevent center joint 58 from interfering with sail 96.

Figure 9:
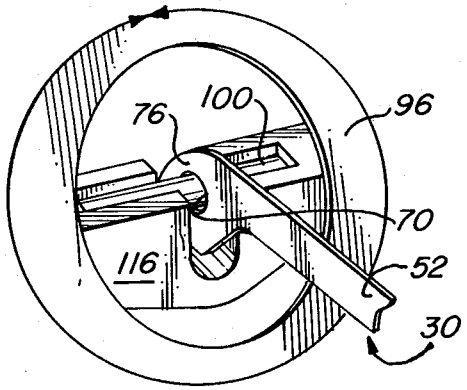
FIG. 9 is a partial enlargement of FIG. 7 depicting how the bridle of FIG. 5 may be attached at its ends to the kite.

FIG. 9 is a partial enlargement of FIG. 7 showing how ends 76 and 78 of bridle 30 may be attached to kite 92. While ends 76 and 78 may be mounted in various ways to virtually any kite, end 76 is shown as preferably mounted to frame member 100 within a wing section 116 described in detail in U.S. Pat. No. 4,760,979. Frame member 100 fits through hole 70 in end 76. End 78 is preferably mounted to kite 92 in similar fashion.

Figure 10:
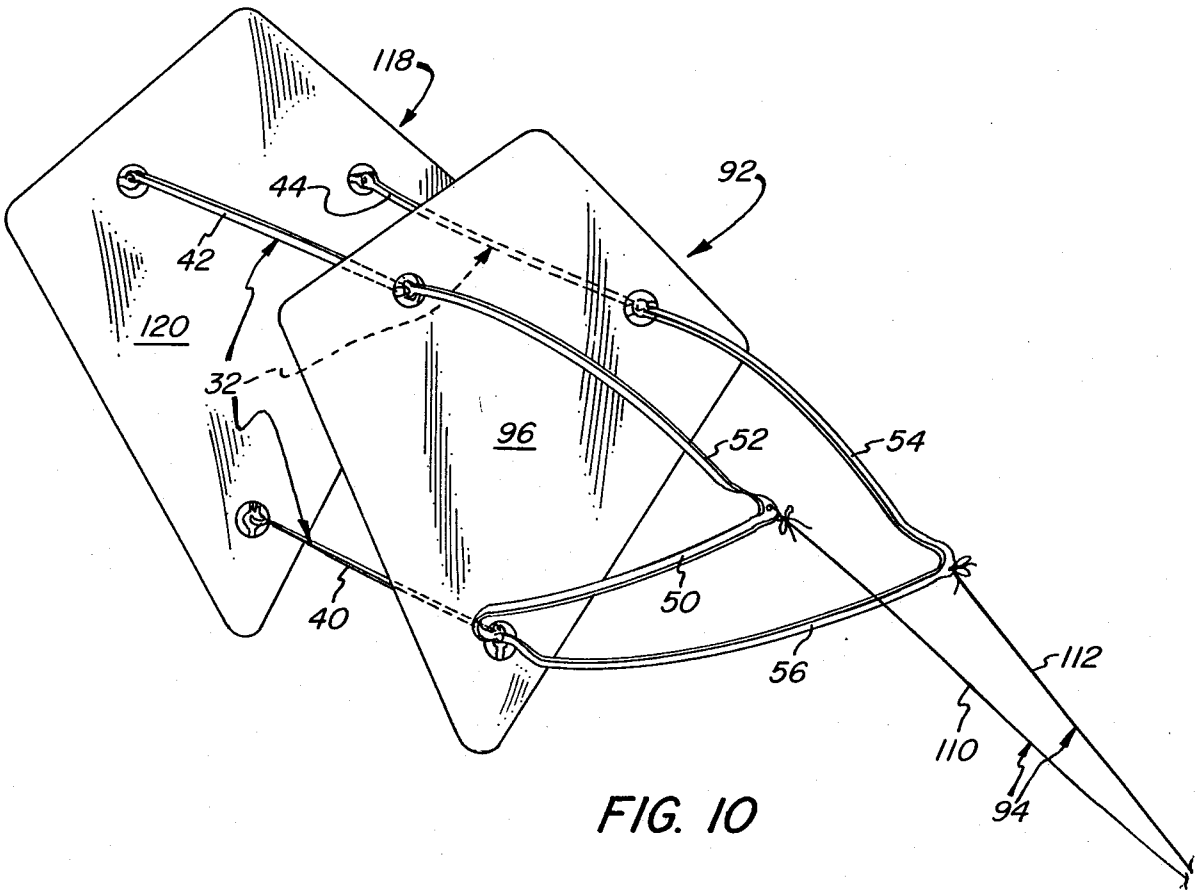
FIG. 10 is a perspective view of two kites connected together with the link of FIG. 6 in order that both may be flown with a single flying line.

Referring now to FIG. 10, a second kite 118 having a sail 120 is shown attached to kite 92 with link 32. Link 32 holds second kite 118 parallel to kite 92 because pieces 40, 42, and 44 are of equal length. It should be understood that link 32 may be used to interconnect a plurality of kites or sails.

The above description is not meant to describe in detail each and every modification and variation which will be apparent to a person skilled in the art.

What is claimed is:

1. A detachable bridle for connecting a flying line to a kite, comprising:

a sheet of a bendable polymeric material having high longitudinal strength;

a continuous cut on the sheet which provides a single length of the polymeric material having at least four branches, the four branches being joined at least three joints;

means, located at a middle joint and at ends of the single length, for detachably mounting the single length to the kite; and means, located at the other two joints, for connecting a flying line to the single length.

2. The detachable bridle of claim 1 wherein the continuous cut further provides at least three equivalent lengths, each of the three equivalent lengths having at least one hole at each end for linking a second kite to the kite at three points.

3. The detachable bridle of claim 2 wherein the three equivalent lengths are cut from between the four branches of the single length.

4. The detachable bridle of claim 1 wherein the detachable mounting means further comprises at least one hole in the single length.

5. The detachable bridle of claim 1 wherein the connecting means further comprises at least one hole in the single length.

6. The detachable bridle of claim 1 wherein the length of the polymeric material further has a tensile strength sufficient to support at least two kites.

7. A bridle for a kite having a sail, a first frame member extending between a nose portion and a tail portion of the sail, and a second frame member extending from a first wing of the sail across the first frame member to a second wing of the sail, the bridle comprising:

a piece of polymeric material having at least one center hole for connection to the first frame member at a position between the second frame member and the tail portion of the sail;

at least two wing holes in the piece of polymeric material for connection to the second frame member on opposite sides of the first frame member; and at least two flying line holes in the piece of polymeric material located between the center hole and each of the wing holes for connecting a flying line.

8. The bridle of claim 7, further comprising an extension for connecting a second kite to the first and second frame members of the first kite.

9. The bridle of claim 7 wherein a distance C between the flying line holes and the center hole is longer than a distance W between the flying line holes and the wing holes by at least about 2½ inches to present the sail to the oncoming breeze at an ideal angle.

10. A device for attaching a flying line to a kite having at least two sails comprising:

a length of thermoplastic material folded at a center into two substantially parallel halves, and each of the halves folded a second time back upon themselves;

at least one center hole in the length of thermoplastic material positioned at the center fold for attaching the length of material to the first sail;

a least one flying line hole in the length of thermoplastic material positioned at each of the second folds for attaching the flying line to the length of material;

at least one end hole in each of the two ends of the length of thermoplastic material for attaching the length of material to the first sail; and a link for attaching the second sail to the first sail, and thereby permit both sails to be controlled by the flying line.

11. The device of claim 10 wherein the link is made from the thermoplastic material.

12. The device of claim 10 wherein at least one center hole is located in a fin extending from and integrally formed with the center of the length of thermoplastic material to attach the length to the kite without interfering with the first sail, and to adjust the angle of the first sail into the oncoming breeze.

* * * * *